US005645641A

United States Patent [19]

Maier

[11] Patent Number: 5,645,641

[45] Date of Patent: Jul. 8, 1997

[54] DEVICE FOR PRETREATING AND/OR COATING THE RUNNING SURFACES OF CYLINDERS

[75] Inventor: Kurt Maier, Leonbert, Germany

[73] Assignee: Mahle GmbH, Stuttgart, Germany

[21] Appl. No.: 522,401

[22] PCT Filed: Feb. 25, 1994

[86] PCT No.: PCT/DE94/00211

§ 371 Date: Sep. 6, 1995

§ 102(e) Date: Sep. 6, 1995

[87] PCT Pub. No.: WO94/24340

PCT Pub. Date: Oct. 27, 1994

[30] Foreign Application Priority Data

Apr. 10, 1993 [DE] Germany ..... 49 11 859.3

[51] Int. Cl.[6] ..... B05C 7/00

[52] U.S. Cl. ..... 118/306; 118/317; 118/DIG. 10

[58] Field of Search ..... 118/214, 216, 118/306, 317, 622, DIG. 10; 427/230, 236, 235, 239; 204/271

[56] References Cited

U.S. PATENT DOCUMENTS

| | | | |
|---|---|---|---|
| 4,281,621 | 8/1981 | Tacke et al. | 118/306 |
| 4,287,237 | 9/1981 | Prudhomme et al. | 118/214 |

FOREIGN PATENT DOCUMENTS

| | | |
|---|---|---|
| 1034447 | 7/1958 | Germany . |
| 2815761 | 10/1979 | Germany . |
| 39 37 763 | 5/1991 | Germany . |

*Primary Examiner*—Laura Edwards
*Attorney, Agent, or Firm*—Collard & Roe, P.C.

[57] ABSTRACT

A device for providing the running surfaces of the cylinders of internal combustion engines with a reinforcing coating. (e.g., a nickel dispersion layer including silicon carbide). The device is designed to hold and convey the cylinder block using a flow-trough process, and includes a baseplate (2) in which a pump (9) and the supply and discharge equipment (4–6) for the bath liquors are integrated. The device is transportable and enables the device to be used over a series of conventional treatment liquor baths.

6 Claims, 1 Drawing Sheet

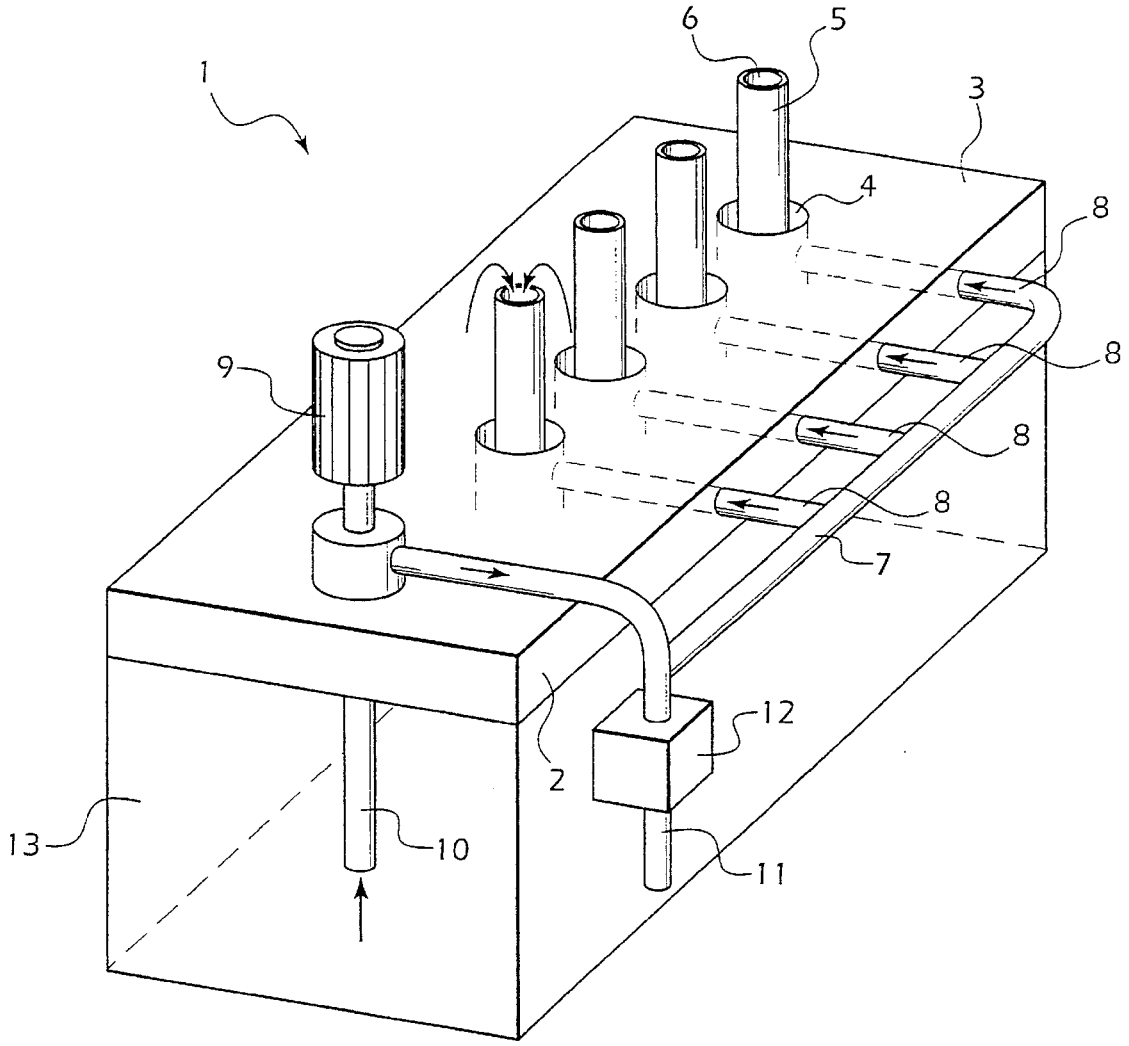
1
6
5
3
4
8
8
9
8
8
7
12
2
13
10
11

DEVICE FOR PRETREATING AND/OR COATING THE RUNNING SURFACES OF CYLINDERS

FIELD OF THE INVENTION

The invention relates to a device for pretreating and/or coating the running surface of individual or a plurality of cylinders combined in one unit.

PRIOR ART

A process for producing such a running surface coating is known from DE-OS 39 37 763. In said process, the cylinder, whose cylinder bores are to be coated, is fitted on the cylinder head side with a sealing plate, on the one hand, and each treatment bath is equipped with a base plate having the feed and drain devices for the bath liquor, a pump and the associated controls, on the other hand. For carrying out the coating process, the cylinder fitted with the sealing plate is transported with a suitable transporting system to the bath, and placed there on the respective base plate. The drawback with this process is that each individual bath has to be equipped with the same type of base plates, pumps and controls.

SUMMARY OF THE INVENTION

Therefore, the problem of the present invention is to find a device for pretreating and/or producing a running surface coating on cylinders that assures, in a simple way of engineering, a favorably priced pretreatment and/or coating of the running surfaces of cylinder bores in the continuous-flow process, whereby the individual treatment liquors are conventionally used in the form of a bath series.

The solution to said problem is obtained with a device with the features according to the invention.

BRIEF DESCRIPTION OF THE DRAWINGS

An exemplified embodiment is explained in greater detail in the following by reference to the drawing according to FIG. 1, which shows a schematized view of the device.

DETAILED DESCRIPTION OF PREFERRED EMBODIMENTS

A device for the pretreatment and/or manufacture of a running surface coating on cylinders of internal combustion engines by depositing a running coating from coating baths, in the present case a nickel-silicon carbide coating, consists of a device 1 with a base plate 2, the latter having a receiving surface 3, on which a cylinder (not shown) rests with its cylinder head side in a sealing way. In accordance with the number of cylinder bores to be coated, the base plate 2 has the feed openings 4 and the pipe risers 5 with the drain bores 6. The bath liquor or liquid used is fed via a manifold 7 and the conduits 8 to the feed openings 4 after it has been withdrawn from the bath container 13 via a pump 9, the latter being integrated in the base plate 2, and the connected suction pipe 10. For the transport of the base plate 2, the latter is equipped with suspension means (not shown), which are commonly used and known per se; the power feed for the pump may take place via such means as well.

For carrying out the actual coating process, the pipe risers 5 are manufactured from known anode metals and connected to electrical feed lines.

So that bath liquor is largely prevented from being dragged along when changing from one bath container to the next, provision is made for a drain conduit 11, which can be opened or closed via a valve 12.

With such a design for continuous-flow coating, in connection with which the cylinder rests with its cylinder head side directly on the base plate 2 in a sealing way, and the cylinder bores are connected with the corresponding feed and drain devices 4 to 6 for the bath liquor, whereby the base plate 2 is moved by means of its transport suspension from one bath to the next, and there simply placed on the bath container in a way such that the suction pipe 10 extends into the bath liquor, a device 1 is created in a simple way of engineering which, without any additional individual elements of the same type on the individual bath devices, assures coating or flushing or cleaning at favorable cost, because provision is made for such elements only once, the latter being integrated in the base plate 2.

I claim:

1. A device for coating the running surface of an individual or a plurality of cylinders combined in one unit by causing different treatment liquors to surge around the surfaces to be coated, the treatment liquors being externally stored from the device and sequentially fed for producing a nickel dispersion coating, the device comprising:

a receiving surface (3) for receiving cylinders with their open bore ends;

at least one feed opening (4) disposed in said receiving surface for feeding the treatment liquors around the surfaces to be coated;

at least one drain device (5–6) disposed within said at least one feed opening for draining the treatment liquors after coating, said drain device extending upward from said receiving surface across the height of the cylinder to be coated and into the cylinder bore; and a pump (9) disposed on said receiving surface and coupled to said at least one feed opening for feeding the externally stored treatment liquors into the cylinder bores.

2. The device according to claim 1, wherein the device is portable.

3. The device according to claim 1, further comprising an open bath container, said device resting on said open bath container during operation.

4. The device according to claim 3, wherein said drain device feeds into said open bath container.

5. The device according to claim 4, further comprising a suction pipe (10) connected to said pump, said suction pipe being immersed in the treatment liquors contained within said open bath container.

6. The device according to claim 1, wherein said at least one drain device (5–6) comprises a pipe riser (5) and a drain opening (6), said pipe riser (5) being an anode metal.

* * * * *

UNITED STATES PATENT AND TRADEMARK OFFICE

CERTIFICATE OF CORRECTION

PATENT NO. : 5,645,641

DATED : July 8, 1997

INVENTOR(S) : MAIER

It is certified that error appears in the above-indentified patent and that said Letters Patent is hereby corrected as shown below:

In the title page, Item [75], change "Leonbert" to --Leonberg--;

Item [30], change "49 11 859.3" to -- 43 11 859.3 --

Signed and Sealed this

Thirtieth Day of December, 1997

*Attest:*

*Attesting Officer*

BRUCE LEHMAN

*Commissioner of Patents and Trademarks*